US006926805B2

(12) United States Patent
Viljanmaa

(10) Patent No.: US 6,926,805 B2
(45) Date of Patent: Aug. 9, 2005

(54) METHOD FOR PRESSING PAPER WEB AND A CALENDER OR A PRESS DEVICE WITH A MOVABLE SHOE ELEMENT

(75) Inventor: Mika Viljanmaa, Helsinki (FI)

(73) Assignee: Metso Paper, Inc., Helsinki (FI)

( * ) Notice: Subject to any disclaimer, the term of this patent is extended or adjusted under 35 U.S.C. 154(b) by 413 days.

(21) Appl. No.: 10/181,067

(22) PCT Filed: Jan. 4, 2001

(86) PCT No.: PCT/FI01/00008

§ 371 (c)(1),
(2), (4) Date: Jul. 12, 2002

(87) PCT Pub. No.: WO01/51705

PCT Pub. Date: Jul. 19, 2001

(65) Prior Publication Data

US 2003/0000672 A1 Jan. 2, 2003

(30) Foreign Application Priority Data

Jan. 13, 2000 (FI) ..... 20000068

(51) Int. Cl.[7] ..... D21G 1/02; D21F 3/08

(52) U.S. Cl. ..... 162/358.3; 162/205; 162/206; 162/358.5; 100/118; 100/121; 100/153; 100/327

(58) Field of Search ..... 162/204–207, 162/210, 358.1, 358.3, 358.5, 361, 362; 100/118, 121, 151, 153, 154, 37, 92, 305, 327; 492/7, 20

(56) References Cited

U.S. PATENT DOCUMENTS

| | | | | | |
|---|---|---|---|---|---|
| 3,269,893 | A | * | 8/1966 | Rojecki | 162/361 |
| 3,293,121 | A | * | 12/1966 | Martin | 162/358.3 |
| 4,287,021 | A | * | 9/1981 | Justus et al. | 162/358.3 |
| 4,431,045 | A | * | 2/1984 | Josefsson | 162/358.3 |
| 4,705,602 | A | * | 11/1987 | Dahl | 162/358.3 |
| 5,614,064 | A | * | 3/1997 | Nykopp | 162/358.3 |
| 5,753,084 | A | * | 5/1998 | Bubik et al. | 162/358.3 |

FOREIGN PATENT DOCUMENTS

| | | | | |
|---|---|---|---|---|
| EP | 1 369 526 | * | 12/2003 | D21G/1/00 |

* cited by examiner

*Primary Examiner*—Eric Hug
(74) *Attorney, Agent, or Firm*—Steinberg & Raskin, P.C.

(57) ABSTRACT

The press device for a paper web, such as a calendar, contains a flexible moving element (1*a*) forming an endless structure, said element forming the shell (1) of a roll, the press device including further a counter roll. Inside the moving element (1*a*) there is a shoe element (3) that is arranged to support the shell (1*a*) against the counter roll to form a nip (N). The width and/or the surface contour of the supporting surface of the shoe element (3) guiding the shell of the roll in the nip contact varies in the machine direction and the shoe element is positionable in the machine direction to adjust the nip width and/or length.

19 Claims, 4 Drawing Sheets

METHOD FOR PRESSING PAPER WEB AND A CALENDER OR A PRESS DEVICE WITH A MOVABLE SHOE ELEMENT

FIELD OF THE INVENTION

The invention relates to a method for pressing a paper web, in which the paper web is guided through a nip formed between a moving element forming a flexible, endless structure and a counter roll, of which the moving element is a flexible shell or a belt loop, the moving element being supported in the area of the nip against the counter roll from by means of a shoe element which determines the shape of the nip. The invention also relates to a press device for a paper web. In this context, the term paper web also refers to such webs made of fibrous pulp, the grammage of which is within a range where products are usually called by the term paperboard.

BACKGROUND OF THE INVENTION

The paper web formed in the wire section is pressed at two points in the line of making paper or paperboard: in the press section, in which water is removed from the wet paper web by pressing, and in the calender, in which the surface is finished by applying pressure on the already relatively dry paper web. Even though the pressing has a different purpose in the press section and in the calender, the web has quite a different dry matter content when it enters these sections, and the technical development of said sections is guided by the phenomena affecting the paper therein, a common feature for both sections is that they both have a nip in which a given pressure affects the web, the pressure being dependent on the force with which the two moving surfaces forming the nip, normally the shell surfaces of two rotating rolls, are pressed against each other from both sides of the web.

For example in a shoe calender, a nip is formed by combining a roll with a soft surface and a hard roll, which nip extends in the longitudinal direction of the machine, and thus the paper web to be calendered has a long retention time in the calender nip. The shell of the roll with a soft surface is made of an elastic flexible belt, and the roll with a hard surface is a metal roll which is a heated roll functioning as a thermoroll bringing heat to the web. The shell of the soft roll is loaded from inside the roll against the hard roll by a loading shoe, and as a result of this, the paper web travelling along the surface of the hard roll is pressed at a given pressure between the surfaces of the soft shell and the hard roll within a long distance in the nip. At the same time, the elastic shell can be compressed in its thickness direction in the area of the nip. The belt forming the shell of the soft roll can be made of a suitable flexible polymer, such as polyurethane, and inside the belt there is a weave that reinforces the same. Thanks to the nip structure, it is possible to attain a good bulk and stiffness for the paper or paperboard, as well as a uniform smoothness of the surface. To sum up, the calender is especially well suited to on-line calendering of printable paper or paperboard grades. Said calender type is called a shoe calender, and it is known by the trademark "OptiDwell". One further embodiment of the same is described in the international publication WO 99/28551.

The surface temperature of the thermoroll can even exceed 300° C. As a result of this, thermal stress is exerted on the shell of the opposite roll in those areas in which the web is not positioned between the surface of the thermoroll and the roll with a soft surface, i.e. outside the edges of the web. The surface of the shell of the roll heats considerably, if it is pressed against the thermoroll under the loading without the paper web therebetween, and in the worst case this leads to the damaging of the belt. In practice this can be avoided in such a manner that an overwide web is passed through the calender nip, by means of which the direct pressurized contact of the surface of the thermoroll and the shell surface of the opposite roll is prevented on the edges, and after the calender edge strips are trimmed away from the web. As a precautionary measure, it is also possible to continuously monitor the surface temperature of the belt and cool down the belt when necessary.

The process of passing an overwide web through the calender is disclosed as a principle in the Finnish patent 83249 and in the corresponding publication GB-2218434. Here, the web is at least as wide as the widest soft-faced roll in the calender, and from this web the edge strips are trimmed away before the reel-up.

The overwide web causes unnecessary broke in the calender. Similarly, the continuous monitoring and control of the surface temperature of the belt requires separate measurement means and cooling means and a corresponding control system solely for the belt.

On the other hand, when a long nip attained by means of a shoe calender is used for calendering of paper or paperboard, process advantage is gained by means of the nip which is longer than the conventional nip formed by means of a roll with a soft surface and a hard roll. The optimal nip length depends among other things on the processed grade, the running speed, the temperature of the thermoroll and the material of the belt brought over the shoe element and on the linear load used. When one wishes to change the nip length for example when the grade is changed, the shoe element has to be changed.

Long nip presses comprising a shoe element with a concave surface in the press section are, in turn, disclosed in the Finnish patent 98843 and in the corresponding U.S. Pat. No. 5,908,536, in the U.S. Pat. Nos. 5,084,137, 5,262,011, 5,639,351, and in the international publication WO 99/19562. In these publications there is a shoe element inside a hose roll, which shoe element is loaded against the inner surface of a flexible roll shell with a given force, and the web is guided together with one or two press felts through a nip formed between the hose roll and a counter roll.

The Finnish patent 65103 and the corresponding U.S. Pat. No. 4,713.147 disclose a manner in which the location of the centre of gravity of the supporting force of the shoe element can be changed in the machine direction, thus enabling the distribution of the dewatering pressure in the longitudinal direction of the nip to be changed. A corresponding idea is disclosed in the U.S. Pat. No. 4,973,384, in which the location of the shoe with a concave surface also changes in the direction of the periphery of the press roll. Corresponding ideas are presented in the German application publications DE-4344165 and DE-3317457. All aforementioned publications share the characteristic that the aim therein is to change the pressure curve in the longitudinal direction of the nip when the length of the nip remains substantially the same.

U.S. Pat. No. 4,705,602 discloses a shoe which is used in the press section in the aforementioned position, the loading part of the shoe being composed of two distinct parts in the machine direction, which parts can be moved with respect to each other. Between the parts a pressure pocket is formed, which is connected to a pressurized medium chamber. When the parts are shifted by motors in the machine direction, it is possible to change the length of the pressure pocket and thereby the retention time in the nip. The shoe intended for changing the length of the nip in the aforementioned manner becomes complex in its structure.

OBJECTS AND SUMMARY OF THE INVENTION

It is an aim of the invention to eliminate the aforementioned drawbacks and to present a method and device in which the processing parameters can be changed by means of a simple solution. The invention results in a calendering method and a calender by means of which it is possible to avoid the harmful effect of a hot thermoroll on the belt without having to run an overwide web. Furthermore, the invention results to a calendering method and a calender, in which the calendering parameters can be generally changed in a more versatile manner with simple structural solutions. Similarly, yet another result is a method to be applied in the press section, in which method the effect of the dewatering pressure can be adjusted in a more versatile manner, as well as a press in which the processing parameters can be changed by means of simple solutions.

To attain the purpose of the invention, the method is primarily characterized in that the nip length and/or width is adjusted by positioning the shoe element. The supporting surface of the shoe element that guides the element into a press contact with a counter roll is shaped in such a manner that when the positions of the guiding surface and the counter roll are adjusted with respect to each other, the dimensions of the nip are changed.

Thus, according to one alternative of the invention, it is possible to adjust the width of the nip line, i.e. the width of the area in which the shoe element presses with its supporting surface the flexible roll shell or the belt of a belt loop and the web guided by said element against the hard-faced roll. The adjustment is conducted by changing the positions of the shoe element and the nip with respect to each other, and the width of the nip line changes, because the width of the pressure-producing surface of the shoe element varies in the machine direction. Thus, the effect of the shoe element can be directed accurately on the width of the web. Especially in the calender, the desired area of influence of the shoe element is attained without pressing the exposed web against the hot roll. However, the correct nip width is also advantageous in the press nip. The adjustable nip width is advantageous, irrespective of the processing stage, if the machine conveying the paper web is designed for a particular width, but the web processed therein is narrower. The shoe element can be arranged to be moved in many ways in the machine direction so that the nip line is shifted to a different location in the shoe element and the width of the nip line changes.

As an alternative to the change in the nip line, the nip length can be changed by transferring the nip line to different locations on the variably shaped supporting surface. The supporting surface has a variable surface contour in the machine direction, which means that the supporting surface has an irregular shape in the vertical cross section of the shoe element taken in the machine direction.

The supporting surface of the shoe element can also be shaped in such a manner that both alternatives are possible in the same shoe element, i.e. by positioning the shoe element it is possible to adjust both the nip width and length.

In the invention, the shoe element is transferred as one entity at least in the part which is bordered by the supporting surface. Thus, the shoe element does not have to be formed of two different parts to change the nip length.

The press device of a paper web according to the invention, in turn, is characterized in that the width and/or the surface contour of the supporting surface guiding the moving element to nip contact varies in the machine direction in the shoe element and the shoe element can be positioned in the machine direction to adjust the nip width and/or length.

Solutions can be applied both in the press nips of the press section and in the calender nips of the calender, even though there are differences in the aforementioned sections of the papermaking process. A considerable increase in the dry matter content takes place in the press section in the nips after the wire section typically from the level of 16 to 25% to the level of 42 to 55%. In a calender in which the dry matter content of the paper is not considerably increased anymore, the dry matter content of the ingoing paper is typically at least 85%.

The flexible moving element, which can be a so-called shell of a "hose roll" or a belt forming an endless loop, is capable of adjusting to the shape of the guiding supporting surface of the shoe element when it travels over the surface. The concept of an elastic moving element, in turn, refers to such a shell or belt forming a loop, which is capable of deforming under the effect of the loading pressure effective in the nip, and so producing a nip which extends in the travel direction of the web.

The shoe element may contain loading devices, which load the shoe against the counter roll located on the other side of the nip. The loading devices may be adjustable, wherein the loading and thereby also the nip pressure can be adjusted.

BRIEF DESCRIPTION OF THE DRAWINGS

In the following, the invention will be described in more detail with reference to the appended drawings, in which.

DETAILED DESCRIPTION OF THE DRAWINGS

Figure 1:
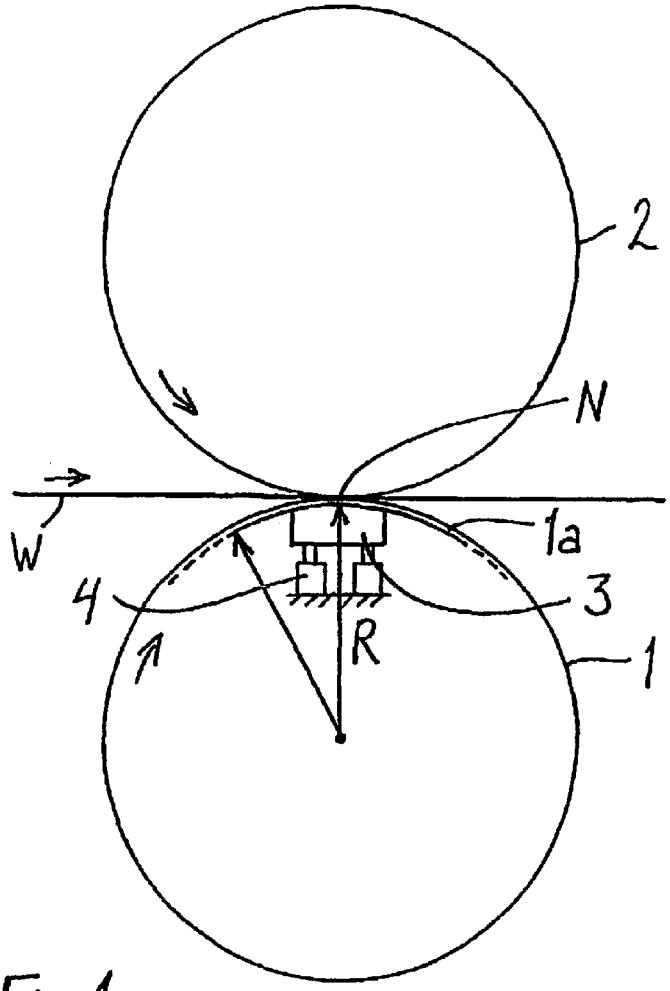
FIG. 1 shows a side-view of a calender in which the invention can be used.

All embodiments shown in the drawings share the characteristic that the supporting surface of the shoe element and the nip are capable of moving with respect to each other in the machine direction, i.e. the nip moves to different points of the supporting surface in the machine direction, and as a result of that the width and/or length of the nip changes. In this context, the term machine direction refers to the travel direction of the web.

Figure 2:
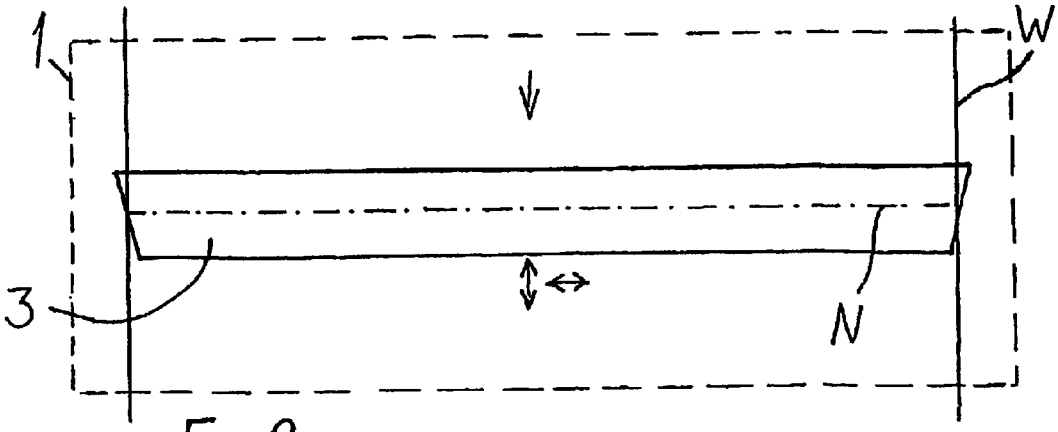
FIG. 2 shows a top-view of a preferred embodiment for adjusting the position of the nip in the calender of FIG. 1.

FIG. 1 shows a calender in which the invention can be used. The paper web W is guided through a calender nip N formed between two rolls. The lower first roll 1 comprises a shell 1*a* made of an elastic flexible material, which rotates around the rotation axis of the calender roll. The upper second roll 2 is a heated calender roll with a hard surface, for example a roll equipped with a metal shell, the surface of which is harder than the elastic flexible material of the shell. The shell that is resilient in its thickness direction (in the direction of the radius of the calender roll 1) pressed into the shape defined by the shoe element 3 guiding the shell from inside and by the surface of the second roll 2, thereby forming a long nip N, in which the web W travels between the surface of the second roll 2 and the surface of the compressed shell 1*a* of the first roll 1. The surface of the shoe element 3 that guides the shell is convex, and it forms a part of a cylinder extending in the direction of the rotation axis of the roll, the radius of curvature of the cylinder and the corresponding centre of curvature being on the side of the first roll 1 from the nip N. In FIG. 2, the radius of curvature R equals the inner radius of the first roll, i.e. the centre of curvature and the rotation axis of the cylinder incide.

The shoe element 3 is loaded against the inner surface of the shell 1*a* by means of loading devices 4, which effect an adjustable loading force. There are several loading devices 4 in the transversal direction of the shoe (in the cross-machine direction) and as can be seen in FIG. 1, there are also two of them successively in the machine direction at several points along the machine width. The loading devices 4 are supported to the axial supporting element inside the roll 1, which in the drawing is marked with hatching. The loading devices can be for example pressure medium operated cylinders or long, hose-like loading members. The junction of the loading devices 4 and the shoe element and/or the loading devices 4 and the supporting element is advantageously such that the shoe element 3 is capable of moving with respect to the roll 1.

Figure 2A:
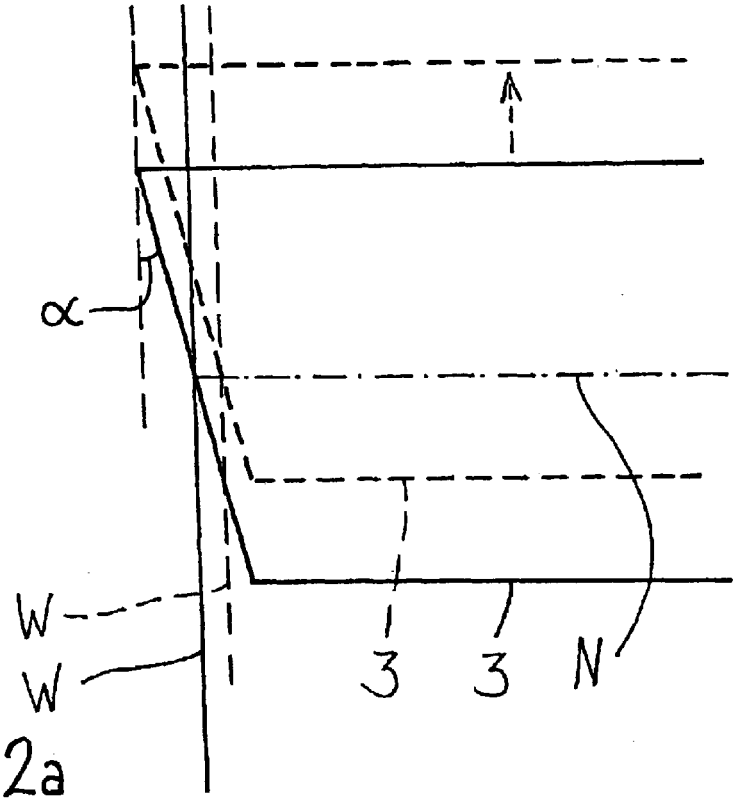
FIG. 2*a* shows the principle of the embodiment of FIG. 2 on a larger scale.

FIGS. 2 and 2*a* show, how it is possible to avoid excessive heating of the compressible shell of the first roll 1 in the shoe calender according to FIG. 1. The second, upper roll 2 is a heated thermoroll, the surface temperature of which can be over 200° C., even over 300° C. The belt forming the shell of the first roll 1 is thus pressed very closely against the surface of the hot roll 2 in those edge areas in which it is positioned outside the edges of the web W. Thus, high temperatures can damage the belt. As was mentioned above, it has been a common practice to "insulate" the belt from the hot roll in the edge areas by passing an overwide web through the calender nip N, of which web edge strips can be trimmed away. FIG. 2 shows a structure by means of which it is possible to accurately adjust the contact between the soft surface of the first roll 1 and the second roll 2 with a hot surface. The shoe element 3 extends as a uniform element in the cross-machine direction and the outer edges of the same, which are located near the outer edge of the web W to be calendered, extend obliquely with respect to the machine direction, both on their respective sides forming with the machine direction an acute angle $\alpha$ opening in the same direction (FIG. 2*a*). The edges are advantageously located symmetrically with respect to the centre line of the machine. Thus, the width of the nip line located in the cross direction (marked with a dotted line in the drawing), i.e. the width of the area in which the shoe element 3 presses the compressible shell against the second roll, can be adjusted by changing the position of the shoe element 3 in such a manner that the nip line travels from one edge of the shoe element 3 to the other in a different point than earlier. In practice, this takes place by transferring the shoe element 3 in the machine direction with respect to the second roll 2. Thus, the width of the nip in the cross direction can be adjusted to accurately correspond to the web width. FIG. 2*a* shows how, during the transfer of the shoe element 3, the edge of the supporting surface of the shoe element moves to a different location along the nip line when the location of the outer edge of the paper web W changes (broken lines in FIG. 2*a*). The contact of the shell located outside the nip in the cross direction with the hot roll does not damage the shell, because in an unloaded contact the effect of the temperature is not so strong.

As it was stated in the description hereinabove, the nip contact is not linear as a result of the effect of the rolls 1 and 2, but it has a particular extension length in the travel direction of the web. In this description the term nip line is used for the centre of the nip.

Figure 3:
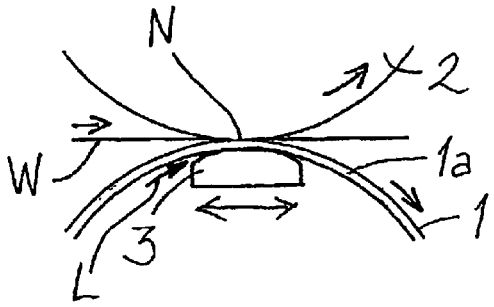
FIG. 3 shows a side-view of the embodiment of FIG. 2.

FIG. 3 shows how the position of the shoe element 3 can be changed by transferring the shoe element 3 linearly in the machine direction. The shoe element 3 may be transferred in this way inside the first roll 1 when the roll remains stationary, wherein the shoe element is transferred in the machine direction with respect to the stationary supporting element located axially inside the roll. The position can also be changed in such a manner that the entire roll 1 together with its supporting element is transferred along with the shoe element 3 in the machine direction in such a manner that the position of the shoe element 3 with respect to the roll 2 is changed. Thus, to maintain the nip contact and a sufficient nip pressure, it may be necessary to adjust the position of the shoe element 3 in the radial direction of the roll 1 at the same time, for example by means of loading devices 4, or to adjust the mutual position of the rolls 1 and 2 in the radial direction. It is also possible that the shoe element 3 is not transferred inside the roll 1, but the counter roll 2 is transferred in such a manner that the nip will be placed at a different point in the supporting surface of the shoe element 3 in the machine direction.

Figure 4:
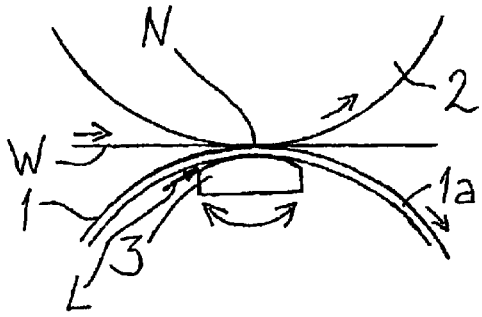
FIG. 4 shows a side-view of a second embodiment.

FIG. 4 shows a second embodiment, in which the transfer takes place by tilting the shoe element 3 with respect to an axis parallel to the rotation axis, wherein the position of the shoe element also changes in the machine direction. Also in this case, the shoe element 3 itself can be tilted inside the roll 1. This can be conducted for example in such a manner that by adjusting the loading devices 4 which are located successively in the machine direction, it is possible to make the element move to a suitably tilted position, or the entire roll 1 and the supporting element can be transferred along with the motion of the shoe element 3. Similarly, the location of the nip line can be changed by transferring only the counter roll 2.

It may be advantageous that it is not necessary to move the rolls 1 and 2 when the width of the nip is changed, wherein only one part, the shoe element 3, has to be transferred, and the rolls can be kept in the same position in the frame of the machine. In the motion paths of the shoe element 3 it is thus possible to take into account the shape of the supporting surface in such a way, that the location of the nip line (the centre of the nip) always remains the same. The motion path of the shoe element can be arranged in such a manner that its loading supporting surface always remains opposite to the same point of the periphery of the second roll 2. In the case of a shoe element with a convex surface, the shoe element can for example be tilted in such a manner that the axis of tilt is in the centre of curvature of the supporting surface. Similarly, the shoe element 3 can be arranged to be transferred with respect to the loading devices 4 so that their direction of action does not change.

Advantageously, the shoe element 3 has a continuous supporting surface, and there is no static oil pocket or pressure pocket on the outer surface of the shoe element. Lubricating oil can be supplied between the supporting surface of the shoe element 3 and the shell 1*a* over the front edge of the shoe element, as illustrated by arrow L in FIGS. 3 and 4.

It should be noted that the flexible shell 1*a* can be located outside the edges of the paper web W against the surface of the thermoroll, but the shoe element 3 is placed in such a manner that the supporting surface effecting the pressure contact in the nip line reaches the edge of the web at the most. It is also possible that the shoe element 3 is positioned in such a manner that the pressurized nip line is located inside the edges of the web in such a manner that a very small unloaded area remains in the edges of the web. Thus, the advantage of the invention is that if desired, it is also possible to adjust the width of that area in the web which remains outside the pressure effect of the nip in the edges, and which can be removed by cutting. For example, if the production of a narrower web is started, the nip width can be adjusted to comply with this width, but the web guided through the nip can be slightly wider than the production width.

The shoe element 3 can be arranged to be transferred inside the roll by actuator solutions known as such. Thus, in the static axial supporting element inside the roll 1, to which element the loading devices 4 are supported, it is also possible to arrange actuators transferring the shoe element 3 in the machine direction. Similarly, the roll 1 and the shoe element 3 can be arranged to be transferred together by actuator solutions transferring the roll 1. Inside the roll 1 it is also possible to arrange guides to ensure that the shoe element 3 glides along a particular path of motion in the machine direction. If the roll 1 and the shoe element 3 are stationary, the counter roll 2 has to be arranged movable, so that the nip line can be arranged in different locations. Thus, it is not necessary to arrange actuators inside the roll 1 to transfer the shoe element in the machine direction.

The transfer movements to the desired position of the shoe element can be conducted by means of positioning devices the principles of which are known, wherein the necessary force can be attained with a mechanical transmission, hydraulically, electrically or magnetically.

It is also possible that the shoe element 3 is movable in the direction of the nip line, i.e. in the cross-machine direction, so that it can be better positioned with respect to the edges of the web W. This possibility is illustrated with transverse arrows in FIG. 2. It is possible to use a suitable positioning device here as well.

Even though the surface of the shoe element 3 that guides the shell la has the same curvature as the inner radius of the shell, it can also have a different curvature or it may be straight. It is also possible that the shoe element 3 has a concave surface. Thus, the embodiment of FIGS. 1 to 4 is not restricted to a particular shape of the guiding surface of the shoe element 3, but the essential aspect is that this surface has a variable width for the purpose of adjusting the width of the nip line.

Similarly, it is sufficient that only one of the edges of the supporting surface of the shoe element 3 deviates from the machine direction, and the other edge is straight. Thus, when the position of the shoe element 3 is changed in the machine direction, the width of the nip line can be made to comply with the transfer of the edge of the web by means of this oblique edge. Thus, by transferring the shoe element 3 in the width direction, it is always possible to align the straight edge with the second edge of the web W.

At least one edge of the shoe element 3 can also be oblique in such a manner that it contains successive straight and oblique sections, wherein the width of the element changes in a stepwise manner.

Figure 5:
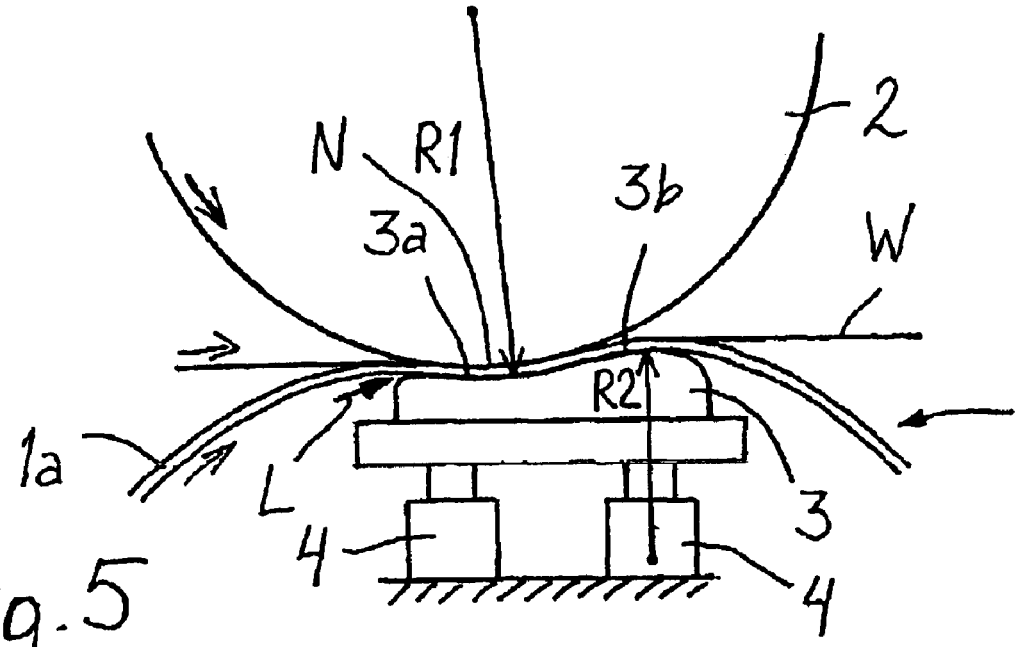
FIG. 5 shows a side-view of a third embodiment, intended especially for the adjustment of nip length.
Figure 6:
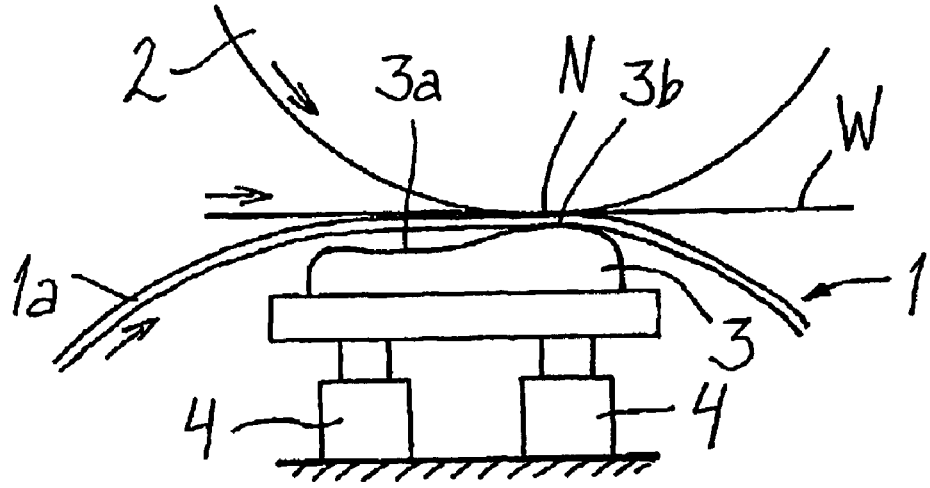
FIG. 6 shows a side-view of the embodiment of FIG. 5 in another position.

FIG. 5 shows a shoe element 3 whose supporting surface guiding the roll shell 1*a* comprises areas of different shapes, wherein when the shoe element 3 is transferred in the machine direction, different areas guide the shell 1*a* to travel in the nip. In the cross-section of the shoe element in the machine direction, taken in the plane perpendicular to the rotation axes of the rolls 1, 2, the supporting surface has a certain profile, whose shape deviates from a regular shape in such a manner that areas of different shapes are produced successively in the shoe element, said areas defining different nip lengths. The profile may contain a straight and a curved section or sections with different curvatures. Especially the curvature of the supporting surface of the shoe element varies, and as is shown in FIG. 5, the curvature varies in such a manner that the radii of curvature are on the opposite sides of the nip N, wherein a section 3*a*, which is concave towards the counter roil 2 and follows the shape of the periphery of the counter roll is produced therein, as well as a section 3*b* which is convex towards the surface of the counter roll 2. The counter roll 2 can be a heated roll with a hard surface, as was described above. The radii of curvature of the successive sections 3*a*, 3*b* of the supporting surface are represented with symbols R1 and R2, respectively. FIG. 5 shows a situation where the concave section, the radius of curvature of which corresponds approximately to the radius of the counter roll 2 added with the thickness of the shell 1*a*, is in a contact with the inner surface of the shell in which the shell 1*a* is pressed to the nip, and FIG. 6 shows a situation where the convex section 3*b* is positioned to a corresponding contact by moving the shoe element 3 and the counter roll 2 with respect to each other in the machine direction, wherein the nip length is shortened. In practice, this is implemented in such a manner that the counter roll 2 is transferred at the location of the convex section 3*b*.

The dimensioning of the different sections of the supporting surface is not necessarily similar to the one shown in FIGS. 5 and 6. It is possible, that the supporting surface is entirely concave, i.e. the centre of curvature is on the side of the counter roll 2, but the curvature varies from the radius of curvature of the counter roll 2 to a larger one, wherein by moving the shoe element 3 and the counter roll 2 with respect to each other in the machine direction, it is possible to change the section approximately following the periphery of the counter roll 2 to a "straighter", less curved section, wherein the nip length is shortened.

Correspondingly, it is possible that there are only convex sections in the supporting surface of the shoe, wherein the radius of curvature can also change in the machine direction in such a manner that by moving the nip position to different points of the shoe element 3 in the machine direction, the nip length can be changed when the sections corresponding to different curvatures enter in contact, in which the shell 1*a* is guided to the nip N. In the convex shoe element 3 the radius of curvature can vary within a wide range. For example, it is possible that the radius of curvature of the guiding surface of the convex shoe corresponds to the radius of curvature of the roll 1 in one part while the other part may have a larger and/or smaller radius of curvature.

The areas of the shoe element that have different shapes can be positioned to the location of the nip also by positioning the shoe element inside the roll, or by transferring the entire roll 1 together with the shoe element 3.

In all above-mentioned shape alternatives the front and rear edges of the shoe element are bevelled or rounded in shape, wherein the bevelled or rounded sections are not intended for supporting surfaces of the nip contact, but to ensure a problem-free sliding of the shell 1*a* on top of the supporting surface of the shoe element, and off the supporting surface. In a similar manner as described above, the lubricant can be supplied between the guiding surface and the shell 1*a* over the foremost edge of the guiding surface when seen in the travel direction of the shell (arrow L), and a static oil pocket is not necessary.

The supporting surface of the shoe element 3 is a part of a continuous structure, in the sense that it is not composed of separate blocks in the machine direction, which could be transferred closer to and further away from each other. Similarly, the absence of the static oil pocket makes the structure of the supporting surface continuous at least over that portion where the areas to be moved to the guiding contact are located.

The invention is not restricted to the order of the rolls shown in FIGS. 1 to 6. It is, for example possible that the roll 1 or the like equipped with a shoe element is in the upper position and the thermoroll 2 is in the lower position. The shoe element 3 can also at the same time be shaped for the purpose of changing both the nip width and the nip length, wherein the supporting surface has a varying width when seen in a direction perpendicular to the supporting surface, and a varying surface shape in the machine direction.

Hereinabove, the flexible elastic element 1*a* is a roll shell, that is tubular or hose-like and fixed at its opposite ends to the ends of the roll which are journalled rotatable, for example according to a solution described in U.S. Pat. No. 5,098,523, incorporated herein by reference. The roll shell is clearly wider than the shoe element supported to a static element inside the shell by means of loading devices, so that it can have a circular shape at its fixing point to the ends and over the width of the nip line it can travel along a path determined by the supporting surface of the shoe element. It is, however, possible that the flexible, elastic element is a belt instead of a roll shell, said belt forming an endless belt loop, the belt being brought over the shoe element 3.

Figure 7:
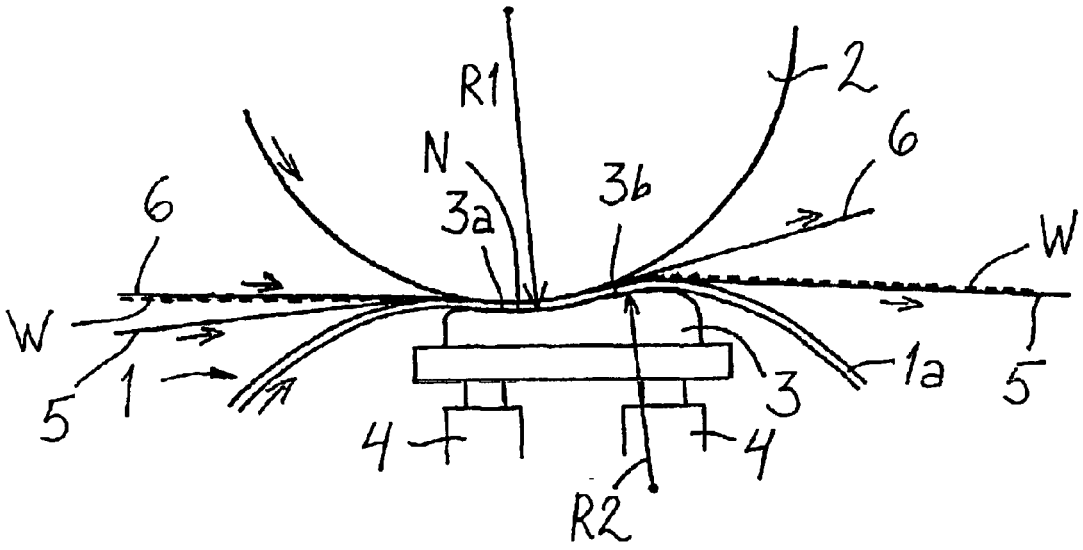
FIG. 7 shows the application of the invention in a press.

In addition to a calender, the invention can also be applied in the press section, taking into account its special requirements. FIG. 7 shows the use of the invention in the press section, wherein a press nip N is formed by means of a flexible hose-like shell 1*a* arranged rotatable and a shoe element 3 guiding the same, in a manner known from so-called long or extended nip structures. The flexible shell 1*a* is fixed to the roll structure in a manner similar to the one described above in connection with the calender rolls. The supporting surface of the shoe element 3 has a variable shape in the machine direction in a similar manner as in FIGS. 5 and 6. The nip length can be adjusted by transferring different points of the supporting surface on the nip line, and thus, it is possible to adjust the length of the press area. When the press pressure can be adjusted by means of loading devices 4 in a manner known as such, the solution according to FIG. 7 can be utilized to affect the dewatering in the press nip N both by adjusting the length of the area in which the web is subjected to the pressure that presses water away from the web, and by adjusting the level of the press pressure. Two press elements 5, 6 are also brought via the nip N, said press elements being in the form of an endless felt or belt passed as a loop around the corresponding press roll 1, 2. On the side of the press roll 1 provided with the shoe element 3, the element 5 is a water receptive press felt, and on the side of the press roll 2 functioning as the counter roll there is also a water receptive press felt as the element 6. The lower element 5 shown in FIG. 7 can also be a belt with a closed surface, which is substantially non-receptive to water and, unlike the porous press felt, capable of intaking at the most an amount of water corresponding to its surface roughness. This element 5 can function as a transfer belt known as such for transferring the paper web that has travelled between the elements 5, 6 through-the press nip N to the drying section, wherein the press nip N shown in the figure is the last nip in the press section. In FIG. 7, the roll 1 equipped with the shoe element 3 is located in the lower position, but it can also be in the upper position and the counter roll 2 in the lower position.

Furthermore, it is possible that the supporting surface of the shoe element 3 has a variable width in the machine direction to adjust the nip width with the same principle as in the calender. The shoe element of the press can also be shaped in such a manner that it only contains a possibility to adjust the nip width.

What is claimed is:

1. A method for pressing a paper web (W), comprising the steps of:

guiding a paper web through a nip (N) formed between a flexible moving element (1*a*) forming an endless structure, and a counter roll (2), of which the moving element is a flexible shell or a belt loop, the moving element (1*a*) being supported in the area of the nip against the counter roll (2) by means of a shoe element (3) which determines the shape of the nip, and adjusting nip length and/or width is by positioning the shoe element (3) as one entity at least in the part which is bordered by the supporting surface that guides the moving element (1*a*); wherein at least one side edge of the supporting surface of the shoe element (3) extends obliquely in the machine direction.

2. The method according to claim 1, wherein the width of the supporting surface guiding the moving element (1*a*) varies in the machine direction in the shoe element (3) and the width of the nip (N) is adjusted by changing the mutual position of the shoe element (3) and the nip (N) in the machine direction.

3. The method according to claim 1, wherein the nip length is changed by transferring different areas of the guiding surface of the shoe element (3) in a guiding contact with the moving element (1*a*), wherein different areas guide the element to travel distances of different length in the nip (N).

4. The method according to claim 1, wherein the nip length and/or width is changed by transferring the shoe element (3) inside the endless structure, such as a roll shell or a belt loop, formed by the moving element (1*a*).

5. The method according to claim 4, wherein when the nip width is adjusted, the shoe element (3) is transferred inside the moving element along such a path of motion that the position of the nip (N) does not change in the machine direction.

6. The method according to claim 1, wherein the nip width and/or length is adjusted by transferring the shoe element (3) and the roll shell (1*a*) around the shoe element together.

7. The method according to claim 1, wherein the nip length and/or width is adjusted by transferring the counter roll (2) in the machine direction to different points of the shoe element (3).

8. A press device for a paper web, comprising:

a flexible moving element (1*a*) forming an endless structure, and a counter roll (2), wherein inside the moving element (1*a*) there is a shoe element (3), which is arranged to support the moving element (1*a*) against the counter roll (2) to form a nip (N), and wherein the width and/or surface contour of the supporting surface of the shoe element (3) that guides the moving element (1*a*) into the nip contact varies in the machine direction and the shoe element (3) is positionable in the machine direction as one entity at least in the part which is bordered by the supporting surface that guides the moving element (1*a*) to adjust the nip width and/or length; wherein at least one side edge of the supporting surface of the shoe element (3) extends obliquely in the machine direction.

9. The press device according to claim 8, wherein both side edges of the supporting surface of the shoe element (3) extend obliquely in the machine direction.

10. The device according to claim 8, wherein at least one side edge of the supporting surface of the shoe element (3) is straight in the machine direction.

11. The device according to claim 9, wherein the side edges are located substantially symmetrically with respect to the centre line of the machine.

12. The device according to claim 8, wherein the supporting surface of the shoe element (3) there are successive areas (3*a*, 3*b*) with different curvatures.

13. The device according to claim 12, wherein the supporting surface there are successive areas (3*a*, 3*b*) whose curvatures extend to different directions.

14. The device according to claim 8, wherein the shoe element (3) is movable substantially in the direction of the nip line in the width direction.

15. The device according to claim 8, wherein the counter roll (2) has a harder surface than the moving element (1*a*).

16. The device according to claim 8, wherein said device is a calender.

17. The device according to claim 16, wherein the counter roll (2) is a heated thermoroll.

18. The device according to claim 16, wherein the moving element (1*a*) forming the endless structure is the roll shell of a calender roll.

19. The device according to claim 8, wherein the device is a press for removing water from a paper web by pressing.

* * * * *